US006374515B1

(12) United States Patent
Davis

(10) Patent No.: US 6,374,515 B1
(45) Date of Patent: Apr. 23, 2002

(54) SHOE HAVING A FLOATING INSOLE

(76) Inventor: Howard F. Davis, 45 W. 132nd St., Suite 3N, New York, NY (US) 10003

( * ) Notice: Subject to any disclaimer, the term of this patent is extended or adjusted under 35 U.S.C. 154(b) by 0 days.

(21) Appl. No.: 09/707,224

(22) Filed: Nov. 6, 2000

Related U.S. Application Data

(60) Provisional application No. 60/184,040, filed on Feb. 22, 2000.

(51) Int. Cl.[7] ..... A43B 13/00; A43B 13/08; A43B 23/00; A43B 13/42; A43B 23/22

(52) U.S. Cl. ..... 36/97; 36/112; 36/103; 36/30 R; 36/31; 36/44; 36/76 C; 36/72 A

(58) Field of Search ..... 36/97, 112, 102, 36/103, 104, 7.1 R, 7.3, 8.1, 8.3, 8.4, 30 R, 31, 43, 44, 45, 76 C, 72 A, 73

(56) References Cited

U.S. PATENT DOCUMENTS 2,497,175 A * 2/1950 Mantos ..... 36/97
4,554,749 A * 11/1985 Ostrander ..... 36/102
4,944,099 A * 7/1990 Davis ..... 36/97
5,682,685 A * 11/1997 Terlizzi ..... 36/8.3
5,813,145 A * 9/1998 Prober ..... 36/97
5,956,868 A * 9/1999 Stevens et al. ..... 36/8.3
6,101,743 A * 8/2000 Brown ..... 36/102
6,138,385 A * 10/2000 Jungkind et al. ..... 36/97

* cited by examiner

*Primary Examiner*—Anthony Stashick
(74) *Attorney, Agent, or Firm*—Cohen, Pontani, Lieberman & Pavane

(57) ABSTRACT

A shoe having an expandable shoe upper includes an outsole having a rear outsole and a front outsole and an expandable insole with a rear insole and a front insole. The front insole is movable relative to a length of the rear insole as the shoe upper expands from an unexpanded position to a fully expanded position. As the shoe upper expands, a gap is created between the heel and front outsole. At least one of the front insole and the rear insole covers the gap to protect a wearer's foot in an area of the gap when the shoe upper and expandable insole expand toward the fully expanded position.

7 Claims, 8 Drawing Sheets

SHOE HAVING A FLOATING INSOLE

RELATED APPLICATION

The present application claims the benefit of the filing date of co-pending provisional application No. 60/184,040, filing date Feb. 22, 2000 the entire contents of which are incorporated herein by reference.

BACKGROUND OF THE INVENTION

1. Field of the Invention

The present invention relates to a shoe having an expandable upper that expands along the length of the shoe and an insole for the shoe.

2. Description of the Related Art

Shoes having expandable uppers typically include outsoles including a rear portion and a front portion. An elastic shoe upper connects the front and rear of the shoe and allows the shoe to expand. These shoes are expandable along a length of the foot to receive various sizes of feet. The expandability of these shoes allows for swelling of feet or allows the shoe to comfortably fit a growing child as the child's foot size increases up to two shoe sizes.

A problem with these prior art shoes is that as the shoe expands, the front part of the outsole is separated from the heel part thereby creating a gap. The elastic shoe upper that connects the rear portion to the front portion of the outsole, while being waterproof, does not provide the same physical protection of the foot from pebbles, rocks, and other debris on the walking surface as the outsole does.

SUMMARY OF THE INVENTION

An object of the present invention is to provide an insole for a shoe with an expandable shank that protects the entire length of the wearer's foot, especially at the area of expansion.

The object of the present invention is met by a first embodiment of an expandable shoe having a shoe upper expandable from an unexpanded position to a fully expanded position and a two part outsole with a rear outsole and a front outsole. The shoe is expandable along the length of the shoe such that a gap is created between the heel and the front outsole when the shoe is at least partially expanded. According to the present invention, the shoe further comprises and insole arranged so that the insole covers the gap created between the rear outsole and the front outsole to protect the wearer's foot when the shoe is in an expanded state. The insole may be made of any material typically used for shoe soles such as leather, synthetic material, rubber, or plastic material. Furthermore, the insole may be connected to either the shoe upper or the outsole at either the front end or the rear end of the shoe.

For ease of assembly, it is desirable for some shoes to have a full length insole which is connected to the shoe upper at both the front end and the rear end of the shoe. To that end, a further embodiment of the present invention includes an insole with a rear insole and a front insole. The rear insole and front insole are both made of leather, synthetic material, plastic material, rubber, or other material having a rigidity suitable for protecting a bottom of a wearer's foot. The insole according to this embodiment further comprises an expandable part connected between the rear insole and the front insole made of neoprene, elastic, or other expandable material. A front portion of the expandable part is connected to a front area of the front insole and a rear portion of the expandable part is connected to a front area of the rear insole (the front of the rear insole is typically located in the shank portion of the shoe located behind the ball of the foot).

As in the first embodiment, the inventive insole is used with a shoe having an expandable upper and a two part outsole, wherein a gap is created between the two parts of the outsole when the expandable shoe upper expands toward a fully expanded position. The rear insole is arranged so that it covers the gap created between the two parts of the outsole. Therefore, when the shoe upper expands, the rear insole protects the bottom of the wearer's foot from objects on the ground such as pebbles, rocks, and other debris. The front insole and the rear insole overlap even when the expandable upper is in the fully expanded state. Therefore, even if the gap between the front and rear parts of the outside is located where the front and rear insoles overlap, the wearer's foot always is protected from obstructions on the ground from the unexpanded to the fully expanded positions.

The embodiment of the insole having an expandable part allows the front insole to move forward relative to the rear insole while maintaining a connection of the front and rear insoles via the expandable part.

The expandable part may be arranged either on top of the front insole or beneath the front insole. As a further alternative, the expandable part may be arranged above or below the rear insole and connected to the rear end of the rear insole and the rear end of the front insole. Furthermore, the front insole and rear insole are not required to overlap. A space may be present between the front insole and the rear insole in the expanded state and/or the normal state. The important criteria is that the front insole or the rear insole covers the gap created between the heel and the front outsole when the expandable upper lengthens. Accordingly, the expandable part may be connected between the front end of the rear insole and the rear end of the front insole.

The object of the present invention is also met by an insole having an insole portion and a front pocket portion that slips over the front of the insole portion. Of course, the parts may be reversed so that the insole comprises a rear pocket portion that slips over the rear of the insole portion.

Existing shoes are expandable along a length of the shoe and typically comprise an expandable shank area made of neoprene or other expandable material. Accordingly, when the shoe is in at least a partially expanded state, a gap forms between the two parts of the two part outsole. The portion of the prior art shoe above the gap is exposed to physical obstructions with only the expandable shank portion for protection. However, the use of the inventive insole according to the present invention protects the wearer's foot in the area of the gap between the two parts of the outsole.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein like reference characters denote similar elements throughout the several views.

DETAILED DESCRIPTION OF THE PRESENTLY PREFERRED EMBODIMENTS

Figure 1:
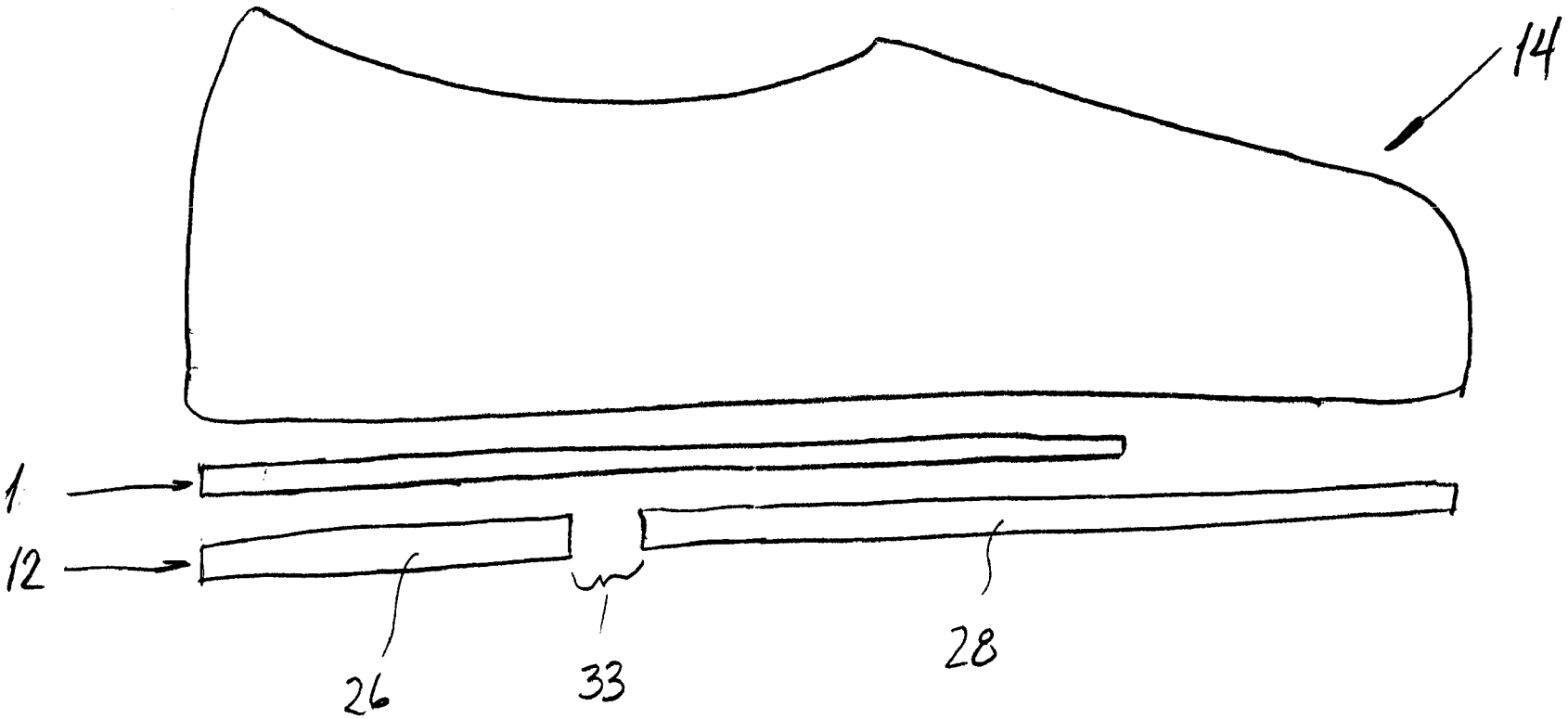
FIG. 1 is a longitudinal sectional view showing a first embodiment of a shoe with an expandable upper according the present invention.

FIG. 1 discloses a first embodiment of an insole 1 according to an embodiment of the present invention. The insole 1 may be made of any material typically used for shoe soles such as leather, synthetic materials, rubber, or plastic material. The insole 1 is arranged in a shoe having an expandable shoe upper 14 which may be made from neoprene, elastic, or any other expandable material. The shoe further includes a two-part outsole 12 with a rear outsole 26, which may be a heel of the shoe, and a front outsole 28. As the shoe expands, the shoe upper 14 lengthens and the rear outsole 26 and the front outsole 28 separate, thereby creating a gap between the rear outsole 26 and the front outsole 28. The insole 1 is arranged over the gap 33 in the outsole 12 and thereby affords physical protection in the area of the gap 33 to a wearer of the shoe. Only one end of the insole 1 is connected to the shoe. The insole 1 may be connected to either the rear end of the shoe as shown in FIG. 1 or the front of the shoe.

Figure 2:
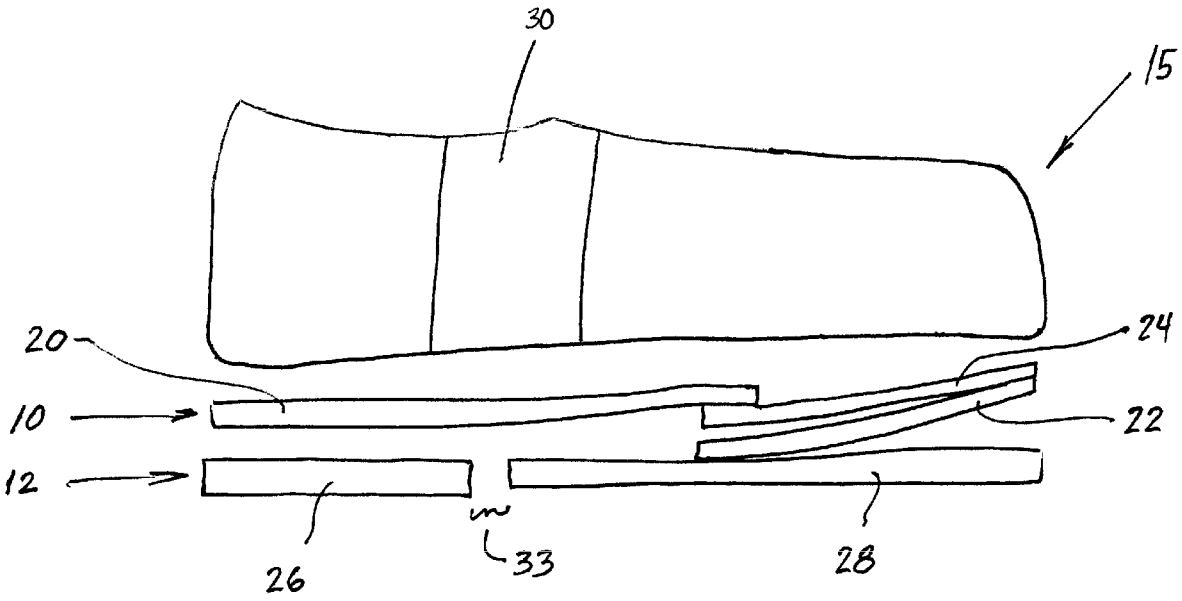
FIG. 2 is a longitudinal sectional view showing another embodiment of a shoe with an expandable shank portion comprising an insole and an outsole according to the present invention.
Figure 3:
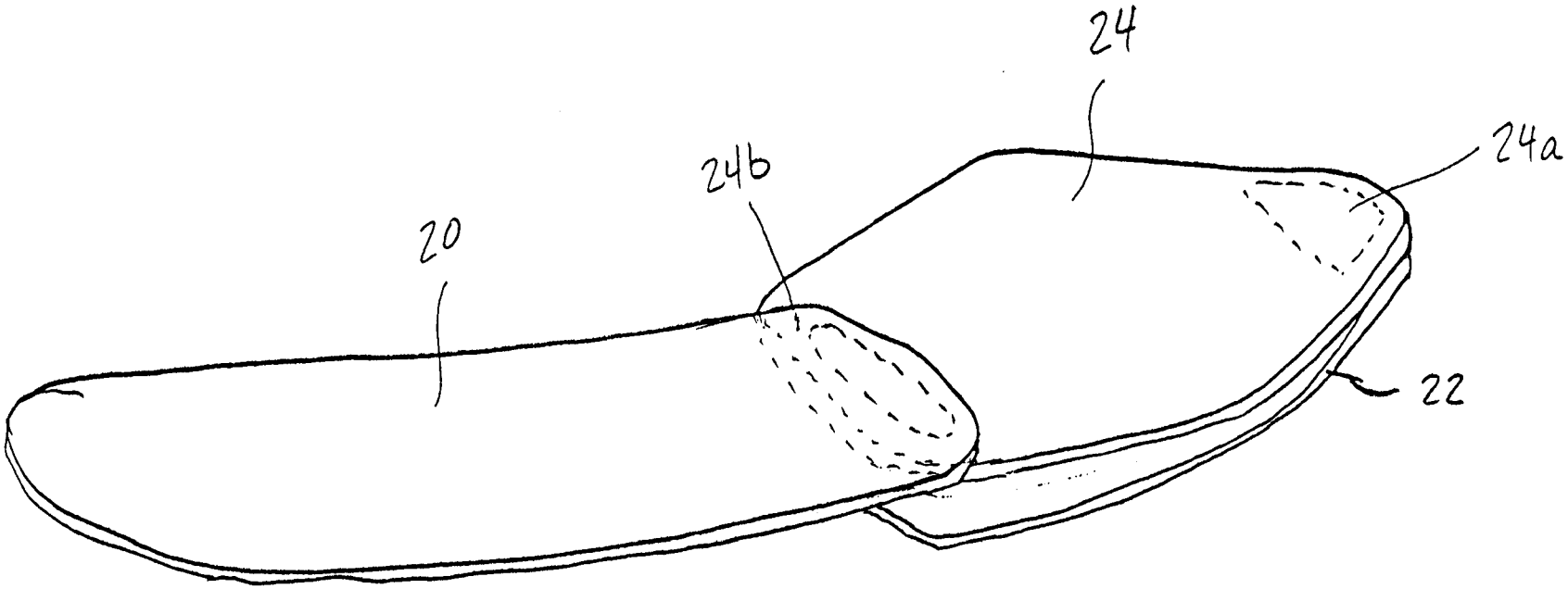
FIG. 3 is a perspective view of the embodiment of the insole of FIG. 2 according to the present invention.

For purposes of assembly, it is desirable for some shoes to have a full length insole which is connected to both the rear end and the front end of the shoe so that the shoe upper can be connected to the insole in its final form. FIGS. 2 and 3 disclose a further embodiment of an insole 10 according to the present invention in which the insole 10 includes a rear insole 20 and a front insole 22 which may be made from any material typically used for shoe soles such as leather, synthetic material, rubber or plastic material. The insole 10 further includes an expandable part 24 made of neoprene, elastic, or other expandable material which holds the front insole 22 to the rear insole 20 during assembly. While it is possible to make the shoe without the expandable part 24, the connection of the front and rear insoles via the expandable part simplifies the assembly of the shoe. The expandable part 24 has a front end 24a connected proximate a front of the front insole 22 and a rear end 24*b* connected proximate to a front of the rear insole 20. Accordingly, the front of the front insole 22 is connected to the front of the rear insole 20 via the expandable part 24. The insole 10 is arranged in a shoe having an upper 15 with an expandable shank 30 made of neoprene, elastic, or any other simplifies the assembly part of the shoe which is expandable along a length of the shoe. The shoe upper 14 of FIG. 1 may alternatively be used in the shoe of FIGS. 2 and 3. Of course, the shoe upper 15 may also be used in the embodiment of FIG. 1.

The shoe of FIGS. 2 and 3 further includes the two part outsole 12 described above having a heel 26 and a front outsole 28. As the shoe upper 15 expands, the heel and the front outsole separate, thereby creating a gap 33 between the heel 26 and the front outsole 28. The rear insole 20 is connected to the rear of the shoe upper 15 which the expandable from an unexpanded orientation shown in FIG. 2 to a fully expanded orientation shown in FIG. 2*a* where the length of the expandable part 24 is shown lengthened. The rear insole 20 lies over the gap 33 and thereby affords physical protection in the area of the gap 33 to a wearer of the shoe.

The expandable part 24 is preferably connected to the front insole 22 and rear insole 20 by stitching. However, the connection may also be effected using adhesives or any other suitable connection method.

Figure 2A:
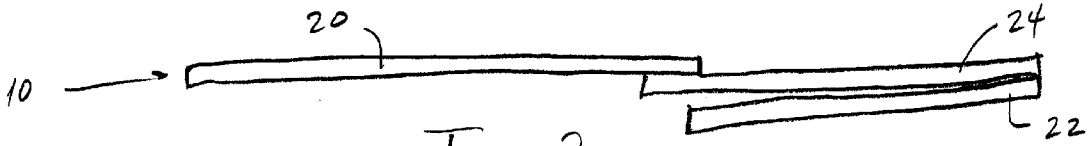
FIG. 2*a* is a longitudinal side view of the insole of the shoe in FIG. 2 in an expanded state.
Figure 4:
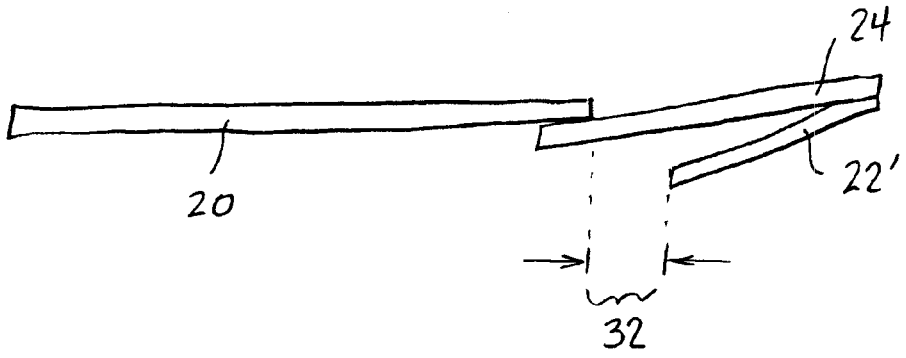
FIG. 4 is a side view of a further embodiment of an insole according to the present invention.

The rear insole 20 may overlap the front insole 22 such that they remain overlapped when the expandable part 24 is fully expanded as shown in FIG. 2*a*. However, this is not necessary for protecting the shank area because the rear insole 20 lies completely over the expandable shank area. Accordingly, a space 32 may be created between the rear insole 20 and the front insole 22' when the expandable part 24 is fully expanded as shown in FIG. 4.

Figure 5:
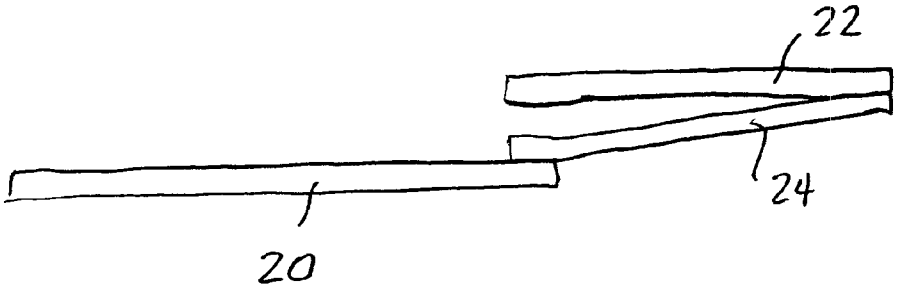
FIG. 5 is a side view of another embodiment of the insole according to the present invention.

Although the preferred embodiment shows the expandable part 24 on top of the front insole 22 and the rear insole 20 on top of the expandable part 24, other configurations are also possible. For example, the front insole 22 may be arranged on top of the expandable part 24 and on top of the rear insole 20 as depicted in FIG. 5. Furthermore, in any configuration, the rear insole 20 may be connected to the bottom surface of the expandable part 24.

Figure 6:
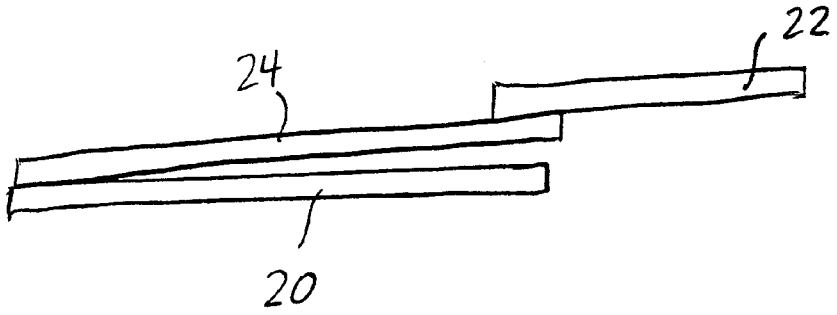
FIG. 6 is a side view of another embodiment of the insole according to the present invention.
Figure 7:
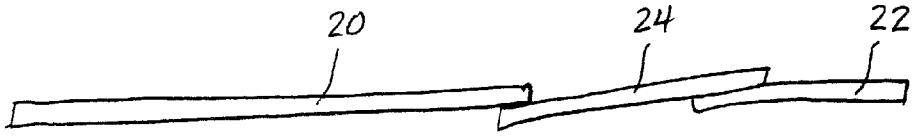
FIG. 7 is a side view of yet another embodiment of the insole according to the present invention.

FIGS. 2 and 3 further show that the expandable part 24 of the preferred embodiment has an unextended length substantially equal to the length of the front insole 22. However, the unextended length of the expandable part 24 may also be shorter than or longer than the front insole 22. For example, the expandable portion 24 may be arranged so that it is connected proximate the front end of the rear insole 20 and the rear end of the front insole 22 as in FIG. 7. Furthermore, it is also possible to attach the expandable portion 24 proximate the rear of the rear insole and the rear of the front insole 22 as shown in FIG. 6. Although the expandable portion 24 is shown as being attached to the front and rear ends of the front insole 22 and rear insole 20 in FIGS. 2–7, the expandable portion may alternatively be attached to any location therebetween to achieve the proper expandability.

Figure 8:
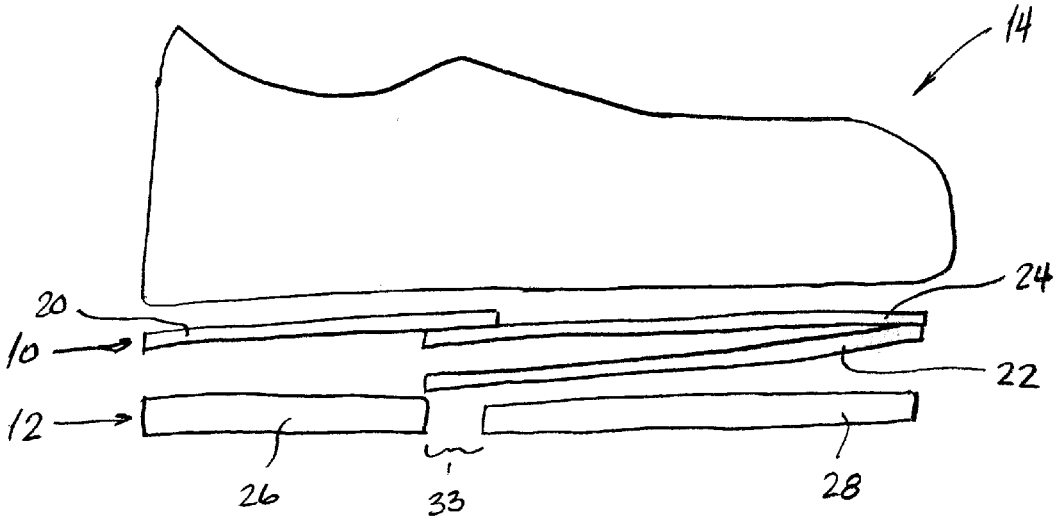
FIG. 8 is a side view of a shoe according to a further embodiment of the present invention.

Furthermore, in the embodiment in which the rear insole 20 overlaps (or underlaps) the front insole 22 even in the fully expanded position of the expandable part 24, the gap 33 may be at least partially located below the overlapped area as shown in FIG. 8. Since the front and rear insoles 22, 20 are always overlapped in this embodiment, the gap is always covered by at least one of the front and rear insoles 22, 20.

Referring again to FIGS. 2 and 3, the shoe having the insole 10 is as assembled as follows: The insole 10 is first attached to a shoe last, not shown, using a known lasting procedure such as with nails or staples. The shoe upper 15 is then slip lasted onto the last. The lower end of the shoe upper 15 is then wrapped around the insole 10 and attached to the front end and rear end of insole. After the shoe upper 15 and insole 10 are removed from the last, the heel 26 and the front outsole 28 of the two part outsole 12 are then separately connected to the shoe upper 15 using a known lasting procedure.

A shoe having the insole 1 and the upper 14 as in FIG. 1 is assembled the same way, except that the front of the insole 1 is not attached to the front portion of the shoe upper.

Figure 9:
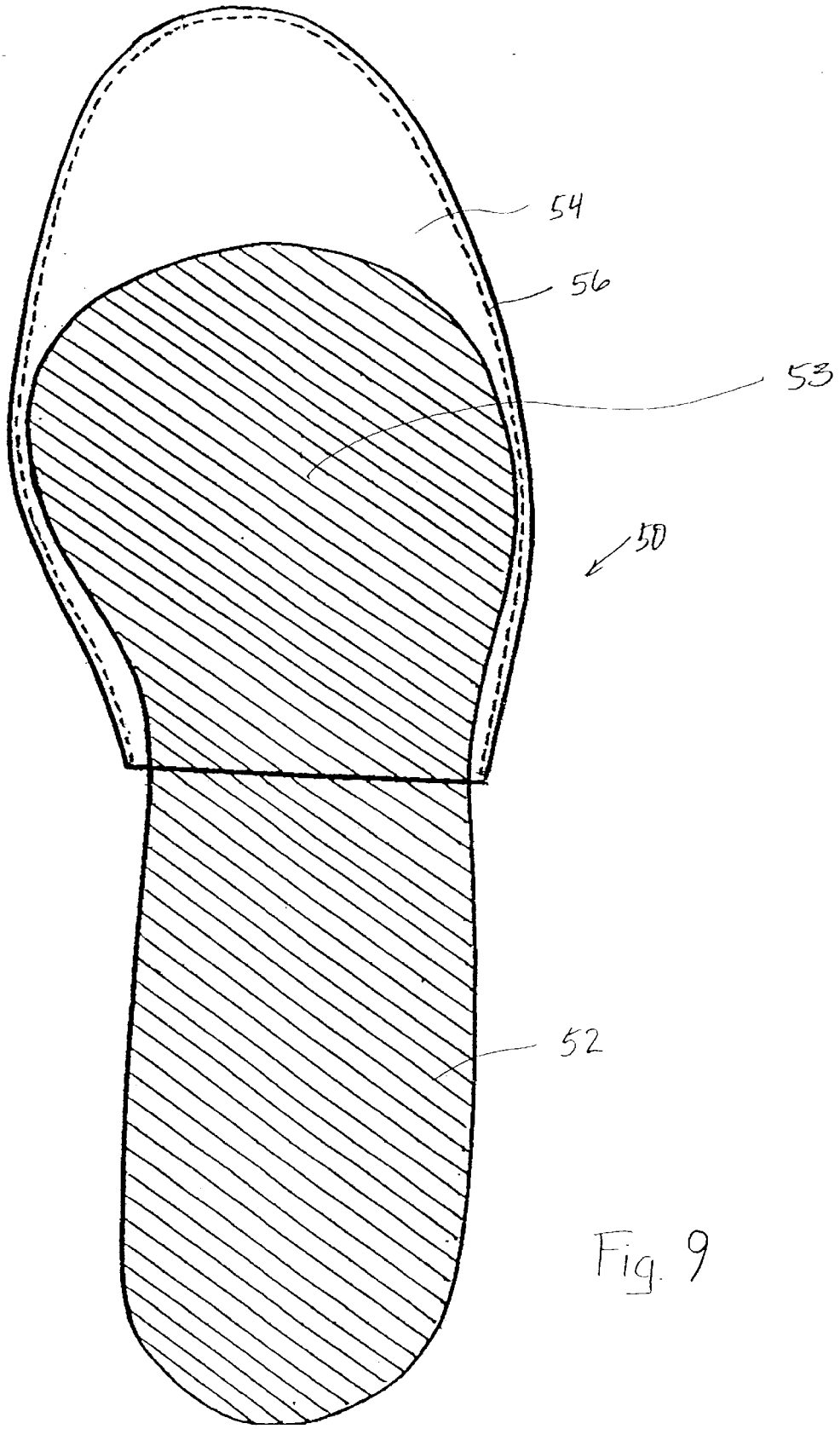
FIG. 9 is a top view of an insole according to another embodiment of the present invention having a pocket part.
Figure 10:
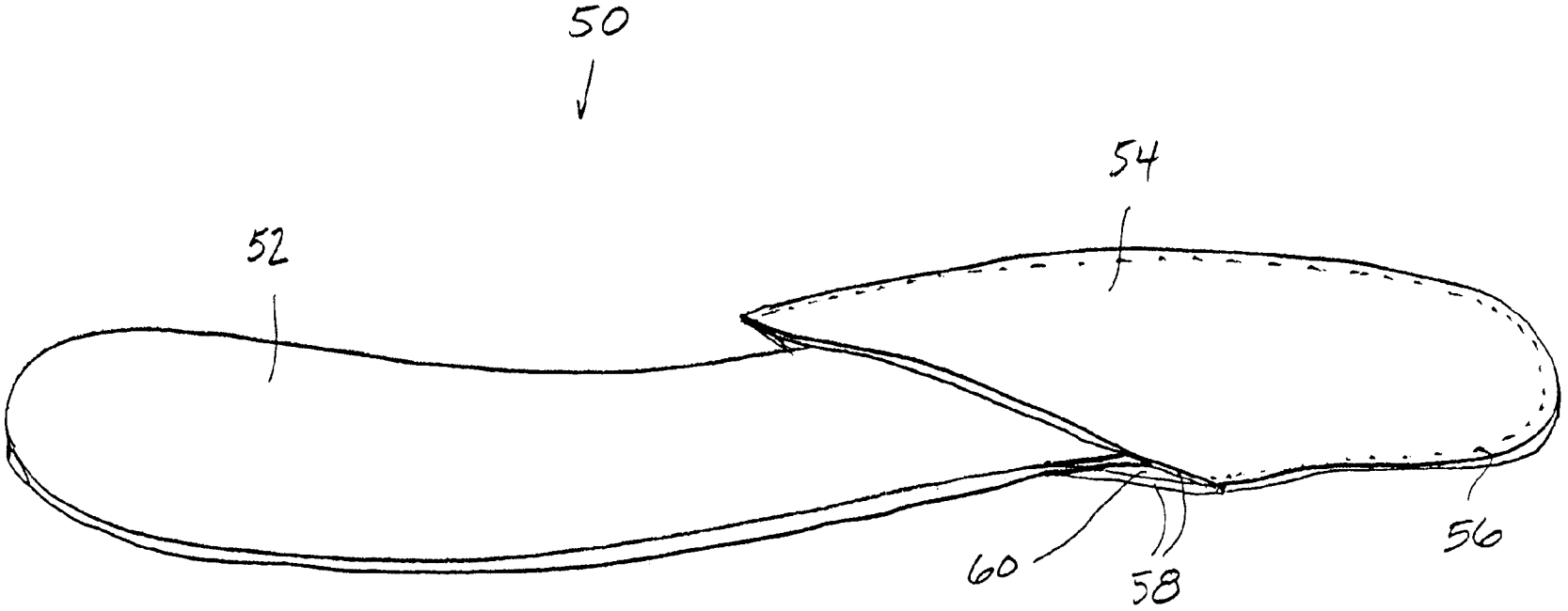
FIG. 10 is a perspective view of the insole in FIG. 9.

In a further embodiment of the present invention shown in FIGS. 9 and 10, an insole 50 includes an insole portion 52 made of leather, synthetic material, rubber plastic material or other suitably rigid material for protecting a wearer's foot from objects on a walking surface and a pocket part 54. A front of the insole portion 52 is inserted in the pocket part 54 so that the insole portion 52 is movable along a length of the insole 50 relative to the pocket part 54. The pocket part 54 is made from two flat pieces 58 connected via a stitching 56 or other suitable connection along the sides and front of the flat pieces 58 with an opening 60 facing a rear of the pocket part 54. In one embodiment, the width of the opening 60 is larger than a width of the insole portion 52 so that the insole portion is removably insertable therein. Alternatively, if the insole portion 52 has a widened area 53 with a width greater than the width of the opening 60, the two flat pieces 58 of the pocket part 54 must be connected with the insole portion 52 in place. In the latter embodiment, the opening 60 is large enough to allow movement of the pocket part 54 relative to the insole portion 52, but smaller than the widened area 53 of the insole portion 52 so that the insole portion 52 is not removable from the S pocket part 54. The flat pieces 58 of the pocket part 54 may be made from the same material as the insole portion 52. Alternatively, the flat pieces 58 may comprise a flexible material such, for example, as soft plastic, leather, fabric, or a synthetic material.

Figure 11:
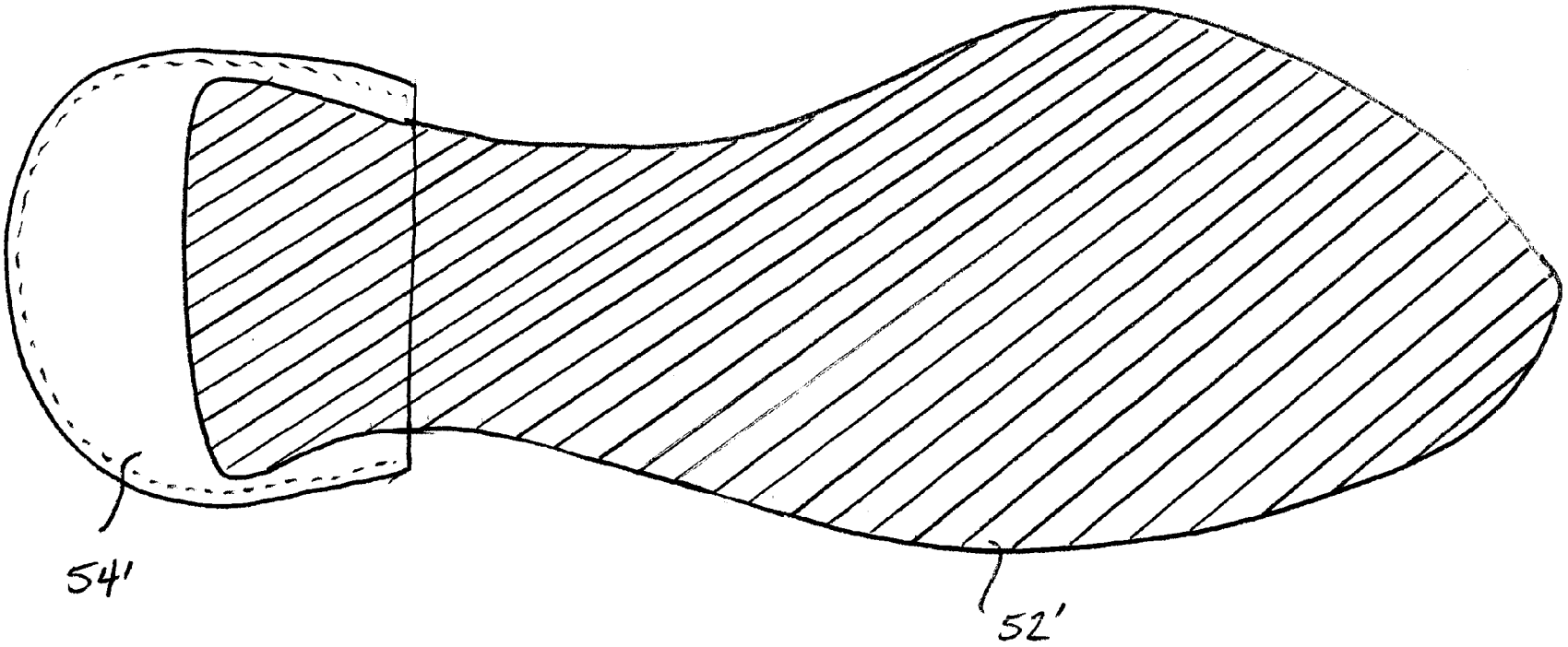
FIG. 11 is a top view of an insole according to yet another embodiment having a pocket part arranged at the heel end according to the present invention.

Of course, it is also possible to arrange the pocket part as a rear part 54' of the insole as shown in FIG. 11. In this embodiment, the front insole portion 52' is made of leather, synthetic material, rubber plastic material or other suitably rigid material for protecting a wearer foot from obstructions on a walking surface. Of course, in any of the embodiments shown in FIGS. 9–11, at least one of the flat pieces 58 of the pocket part may comprise a suitably rigid material for protecting a wearer's foot from objects if the pocket part is arranged over the gap 33 of the outsole 12 (see FIG. 1).

A shoe having an expandable shoe upper 14 and using the insole 50 of this embodiment is assembled as follows. The insole 50 is connected to a last using regular lasting procedures. A shoe upper 14 (see FIG. 1) is slipped lasted on the last in a completely assembled state. The front outsole 28 and the heel 26 are then separately attached to the upper 14 using a standard lasting procedure. During the attachment of the outsole 12, the insole 50 may be connected to the shoe upper 14 at the toe portion and the heel portion so that the pocket part 54 moves relative to the insole portion 52 when the upper 14 is expanded.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An expandable shoe, comprising:

a shoe upper having a front end and a rear end and a shoe length, wherein said shoe upper is expandable along said shoe length from an unexpanded position to a fully expanded position;

an outsole comprising a rear outsole portion connected to said rear end of said shoe upper and a front outsole portion connected to said front end of said shoe upper, wherein said front and rear outsole portions define a gap therebetween when said shoe upper is expanded; and an insole connected to said shoe upper above said outsole, wherein said insole covers said gap for protecting a wearer's foot when said shoe upper expands, said insole comprising a rear insole connected to the rear end of said shoe upper and having a front end, a rear end, and a length and a front insole connected to the front end of said shoe upper and having a front end and a rear end, wherein said front insole moves relative to said rear insole when said shoe upper expands toward said fully expanded position, said insole further comprising an expandable part having a front end fixedly connected to said front insole and a rear end fixedly connected to said rear insole so that said rear insole is connected to said front insole via said expandable part wherein said front end of said expandable part is connected proximate said front end of said front insole and said rear end of said expandable part is connected proximate said front end of said rear insole.

2. An expandable shoe comprising:

a shoe upper having a front end and a rear end and a shoe length, wherein said shoe upper is expandable along said shoe length from an unexpanded position to a fully expanded position;

an outsole comprising a rear outsole portion connected to said rear end of said shoe upper and a front outsole portion connected to said front end of said shoe upper, wherein said front and rear outsole portions define a gap therebetween when said shoe upper is expanded; and an insole connected to said shoe upper above said outsole, wherein said insole covers said gap for protecting a wearer's foot when said shoe upper expands, said insole comprising a rear insole connected to the rear end of said shoe upper and having a front end, a rear end, and a length and a front insole connected to the front end of said shoe upper and having a front end and a rear end, wherein said front insole moves relative to said rear insole when said shoe upper expands toward said fully expanded position, said insole further comprising an expandable part having a front end fixedly connected to said front insole and a rear end fixedly connected to said rear insole so that said rear insole is connected to said front insole via said expandable part, wherein said front end of said rear insole and said rear end of said front insole overlap in said unexpanded position and a gap is created between said front end of said rear insole and said rear end of said front insole in said fully expanded position of said insole.

3. An expandable shoe comprising:

a shoe upper having a front end and a rear end and a shoe length, wherein said shoe upper is expandable along said shoe length from an unexpanded position to a fully expanded position;

an outsole comprising a rear outsole portion connected to said rear end of said shoe upper and a front outsole portion connected to said front end of said shoe upper, wherein said front and rear outsole portions define a gap therebetween when said shoe upper is expanded; and an insole connected to said shoe upper above said outsole, wherein said insole covers said gap for protecting a wearer's foot when said shoe upper expands, said insole comprising a rear insole connected to the rear end of said shoe upper and having a front end, a rear end, and a length and a front insole connected to the front end of said shoe upper and having a front end and a rear end, wherein one of said front insole and said rear insole comprises a pocket part having an opening and the other one of said front insole and said rear insole is inserted in said opening in said pocket part.

4. The expandable shoe of claim 3, wherein said pocket part comprises two flat pieces having edges, wherein said two flat pieces are connected along the edges so that said opening remains between the two flat pieces facing the rear end of said front insole.

5. The expandable shoe of claim 4, wherein said front insole comprises said pocket part.

6. The expandable shoe of claim 4, wherein said rear insole comprises said pocket part.

7. The expandable shoe of claim 3, wherein said insole portion inserted in said opening comprises a widened part and wherein a width of said widened part is larger than a width of said opening, thereby preventing removal of said insole portion from said pocket part.

* * * * *